US005636575A

United States Patent [19]

Hoehn et al.

[11] Patent Number: 5,636,575

[45] Date of Patent: Jun. 10, 1997

[54] CONVEYOR SPEED RETARDER

[75] Inventors: Robert A. Hoehn, Monticello Township, Kans.; Mark A. Pollard, Plattsburg, Mo.

[73] Assignee: Lico, Inc., Kansas City, Mo.

[21] Appl. No.: 557,853

[22] Filed: Nov. 14, 1995

[51] Int. Cl.[6] ..... B61K 7/02

[52] U.S. Cl. ..... 104/250; 104/172.4; 104/249; 188/62

[58] Field of Search ..... 104/26.2, 172.1, 104/172.4, 249, 257, 250; 198/814, 832.2; 188/38.5, 62, 180, 181 R, 181 C

[56] References Cited

U.S. PATENT DOCUMENTS

| | | | |
|---|---|---|---|
| 690,814 | 1/1902 | Acklin | 104/249 |
| 1,541,667 | 6/1925 | Southward et al | 104/250 |
| 1,766,537 | 6/1930 | Prescott | 104/249 |
| 2,582,316 | 1/1952 | Doehler | 188/62 |
| 2,715,369 | 8/1955 | Doehler | 104/26.2 |
| 3,503,471 | 3/1970 | Balke | 104/249 |
| 3,565,012 | 2/1971 | Nearman | 104/172.4 |
| 3,705,554 | 12/1972 | Aksamit | 104/250 |
| 4,089,406 | 5/1978 | Teske et al | 198/814 |
| 4,901,648 | 2/1990 | Moore et al | 104/250 |

FOREIGN PATENT DOCUMENTS

| | | | |
|---|---|---|---|
| 1131255 | 6/1962 | Germany | 140/26.2 |

*Primary Examiner*—S. Joseph Morano
*Attorney, Agent, or Firm*—Chase & Yakimo

[57] ABSTRACT

A retarder apparatus controls the speed of a free, load-carrying conveyor as it moves in a predetermined direction along a path of travel defined by the track in which the conveyor runs. Paddle members are spaced at regular intervals along an endless movable chain and each, in turn, is positioned in the track in the path of the next conveyor. Upon engagement of an individual paddle by an oncoming conveyor, the chain is instantly accelerated to the speed of the conveyor and this motion is transmitted through a chain sprocket to a centrifugal brake which, if a normal speed is being exceeded, limits the speed of movement of the chain to hold back a runaway conveyor and return it to the normal speed.

9 Claims, 5 Drawing Sheets

CONVEYOR SPEED RETARDER

BACKGROUND OF THE INVENTION

This invention relates to improvements in speed control mechanisms for free-running conveyors of an industrial conveyor system and, in particular, to a retarder apparatus which holds back a runaway conveyor and returns it to a normal speed.

In typical power and free conveyors, a load carrier is supported by load trolleys which are coupled to a lead or accumulating trolley that is driven when engaged by a pusher dog projecting from a continuously moving drive chain. The trolleys of the conveyor run in a free track independent from the drive chain which is supported by power trolleys in a parallel, power track. Instances occur in normal operation in which the load-carrying conveyor becomes disengaged from the pusher dog and creates a runaway condition. A free trolley retarder is employed in such systems to control the free conveyor when this occurs.

The conventional retarder is a shoe device that squeezes the sides of a passing free trolley to create a friction point in the system and impede movement of the conveyor unless it is powered by a pusher dog on the drive chain. The shoe is held in an interference position by springs that bear against the shoe and apply the frictional force.

It may be appreciated that since the conventional retarder is a friction device, it creates a "rub" or wear point where the shoe bears against the passing free trolley. Precise control of conveyor speed is difficult with the shoe-type retarder and wear on the free trolleys is inherent when using a retarder of this type.

It is, therefore, the primary object of the present invention to provide an improved retarder apparatus for controlling the speed of a free conveyor, which is capable of returning the conveyor to a predetermined, normal speed and wherein the retarding action is accomplished without significant wear on the trolley components.

In furtherance of the foregoing object, it is an important aim of this invention to provide such a retarder apparatus having a paddle member which extends into the path of travel of the conveyor and is engaged thereby and pushed as the conveyor passes.

Another important object of the invention is to provide such a retarder apparatus in which successive paddle members are connected with a brake means, not in contact with the conveyor, which limits the speed of movement of the conveyor in response to engagement of one of the paddle members by the conveyor.

Still another important object is to provide a retarder apparatus as aforesaid in which the paddle members are spaced along a flexible, endless, movable component trained around a pair of spaced, rotatable devices such as sprockets, a stretch of the component being disposed adjacent the path of travel of the conveyor for movement therewith when a paddle member is engaged, whereby the component is instantly driven at the speed of a passing conveyor and retarded by the brake means if appropriate.

Yet another object of this invention is to provide a retarder apparatus as aforesaid in which the brake means thereof comprises a centrifugal brake for accurately limiting the speed of the conveyor to a predetermined normal speed.

Furthermore, it is an important object to provide such an apparatus in which the stretch of the endless component and the paddle member thereon are supported against deflection or bending in response to engagement of the paddle member by the moving conveyor.

Further objects will become apparent as the detailed description proceeds.

DETAILED DESCRIPTION

Figure 1:
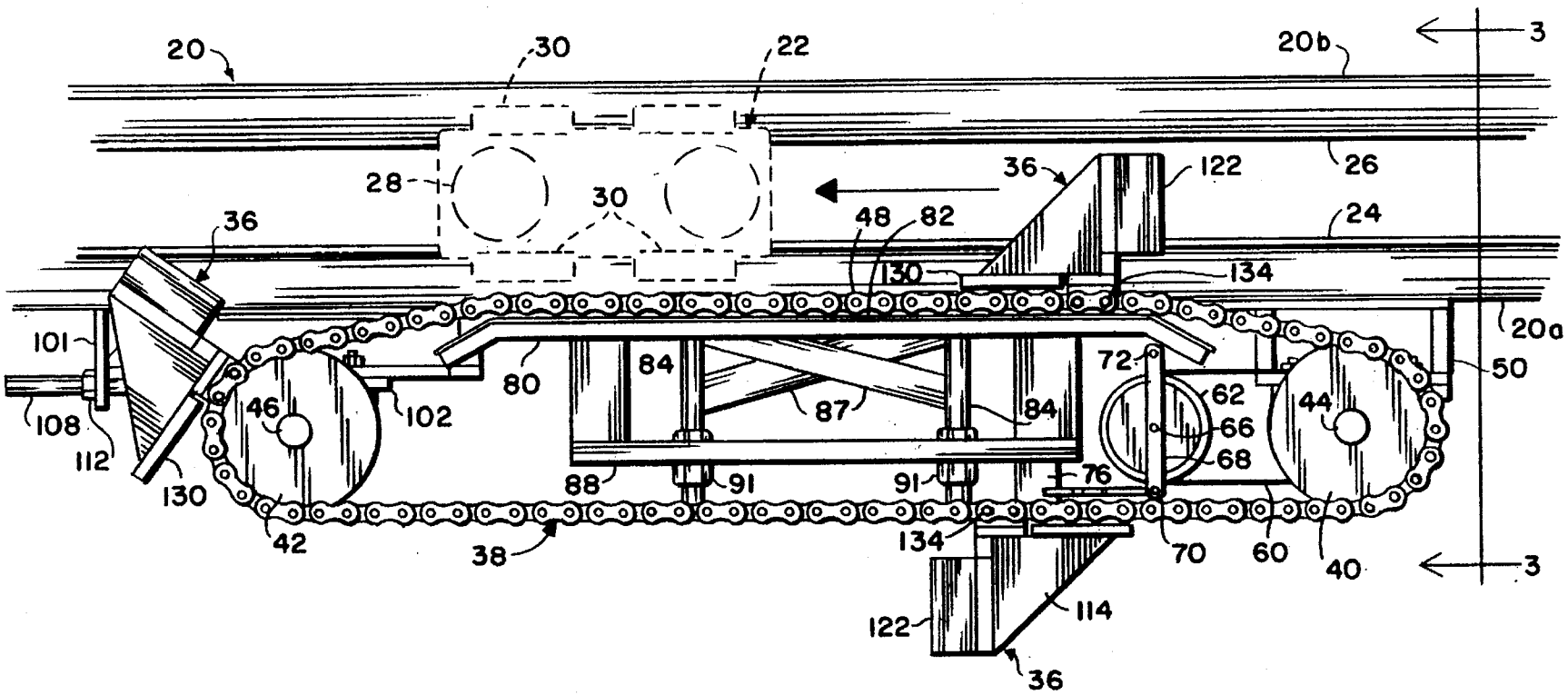
FIG. 1 is a plan view of the retarder of the present invention showing the same mounted on the free track of an inverted, power and free conveyor.
Figure 3:
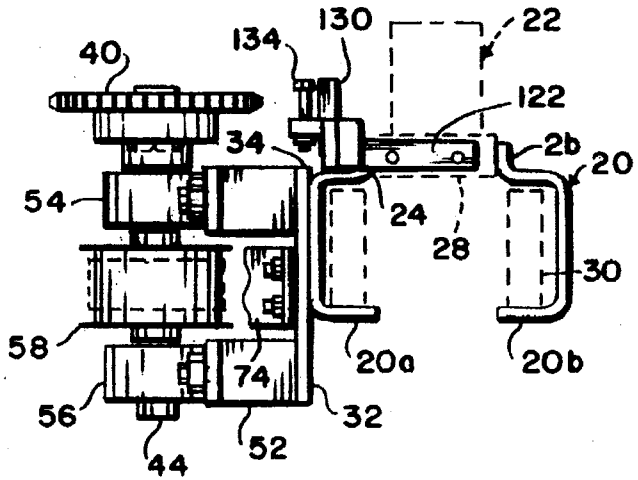
FIG. 3 is a fragmentary, vertical sectional view taken along line 3—3 of FIG. 1, the free track being shown in elevation for clarity.

FIGS. 1 and 3 illustrate a portion of a free track 20 of an inverted power and free conveyor system, a trolley 22 being shown in the track 20 in broken lines. The power track of the conveyor system is not shown, it being understood that it is disposed below and extends in parallelism with the free track 20 and carries the drive chain of the system. The free track 20 is of typical configuration and is formed by a pair of spaced, opposed channel members 20*a* and 20*b* having upturned lips 24 and 26 on their respective upper flanges to present horizontally spaced, vertical surfaces between which horizontally disposed rollers 28 of the trolley 22 run. As is conventional, trolley 22 is also provided with vertically disposed rollers 30 which rotate about horizontal axes and ride on the lower flanges of the channel members 20*a* and 20*b*. It should be understood that lip 24 (FIG. 3) is identical in height to lip 26 throughout the track 20 except at a location at which the retarder apparatus of the present invention is located, as will be appreciated from the following description.

Figure 2:
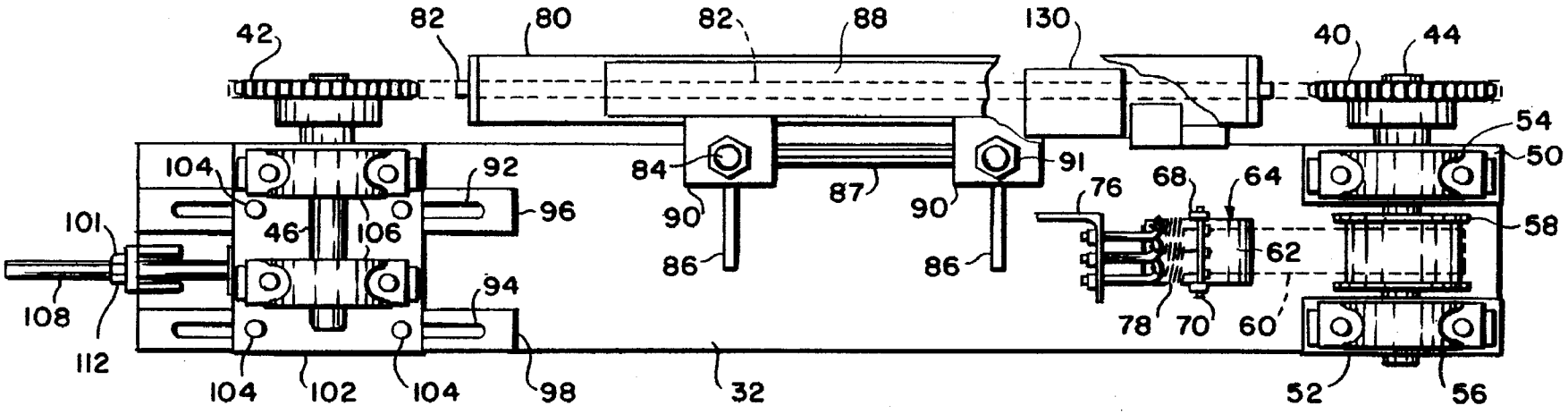
FIG. 2 is a side elevation of the retarder shown in FIG. 1, parts being removed for clarity.

Referring particularly to FIGS. 1–3, an elongated, rectangular, horizontally extending mounting plate 32 is disposed in a substantially vertical plane and is welded to the outer side surface of the channel member 20*a* of free track 20 to provide a support for the components of the retarder apparatus of the present invention. The plate 32 is approximately five feet (1.5 meters) in length and is positioned with its upper longitudinal edge 34 at the level of the shorter lip 24 on channel member 20*a*, such lip being shortened throughout the length of plate 32 and for short distance beyond each end of plate 32 to provide clearance for each of the three paddles 36 of the retarder mechanism to be discussed. The three paddles 36 are secured to a flexible, endless, movable component of the apparatus that, in the illustrated embodiment, comprises a roller chain 38 (RC-100) trained around and engaged by a drive sprocket 40 and a takeup sprocket 42 rotatable about spaced, vertical axes provided by shafts 44 and 46 respectively. The three paddles 36 are spaced at regular intervals along chain 38, the spacing between an adjacent pair of paddles 36 being sufficiently close that one of the three paddles 36 is always positioned on a stretch 48 of chain 38 extending substantially in the plane of mounting plate 32 and above the upper longitudinal edge 34, as may be appreciated by a comparison of FIGS. 1, 2 and 3.

The drive sprocket assembly is shown in FIGS. 1–4 and includes a pair of vertically spaced, generally U-shaped, upper and lower mounting brackets 50 and 52 projecting horizontally from mounting plate 32 and supporting bearing assemblies 54 and 56, respectively, that receive shaft 44. A pulley 58 is disposed on shaft 44 intermediate bearings 54 and 56 and rotates with shaft 44 and sprocket 40. A belt 60 is trained around pulley 58 and the outer drum 62 of a centrifugal brake 64 which limits the speed of rotation of shaft 44 and, therefore, sprocket 40 and chain 38. Brake 64 in the illustrated embodiment has a capacity of 500 to 4,000 inch-pounds and may, for example, comprise an Interroll #4040.

The centrifugal brake 64 is mounted for rotation about a vertical axis 66 by a pair of upper and lower, horizontal mounting arms 68 joined at their outer ends by a cross pin 70 and at their inner ends by a pivot pin 72 which is received by a mating female part on the end of an angle bracket 74 to provide a vertical pivotal axis. An angle member 76 extends horizontally outwardly from mounting plate 32 and provides an anchoring support for three coil springs 78 which are arranged in parallel and are connected to cross pin 70. Accordingly, the springs 78, arms 68 and pivot pin 72 provide a belt tightener to hold the outer drum 62 in frictional contact with drive belt 60.

The stretch 48 of roller chain 38 is supported by an elongated guide 80 in the nature of a backup bar that extends horizontally in general parallelism with the upper longitudinal edge 34 of mounting plate 32, and thus parallel with track 20 and the path of travel of trolley 22. A wear strip 82 is attached to the surface of guide 80 that faces track 20 and presents a surface over which the rollers of roller chain 38 run throughout the extent of stretch 48, it being appreciated that stretch 48 extends from approximately one end of guide 80 to the other.

The position of guide 80 is adjustable toward and away from track 20 in order to properly position chain stretch 48 so that the paddles 36 will be engaged and pushed by the trollies of conveyors on free track 20, as will be discussed. A pair of spaced, horizontally laterally extending rods 84 are welded to mounting plate 32 and supported by respective gussets 86, and are provided with threaded outer ends. Cross braces 87 between the rods 84 provide additional stabilization. A frame 88 of U-shaped configuration (as viewed in plan in FIG. 1) is welded to the outer surface of guide 80 and has a pair of longitudinally spaced tabs 90 depending therefrom which are apertured to receive the threaded ends of corresponding rods 84. Nuts 91 on the threaded ends of rods 84 secure the frame 88 to the rods 84 as desired to properly position the guide 80 with respect to the channel member 20*a*.

Figure 5:
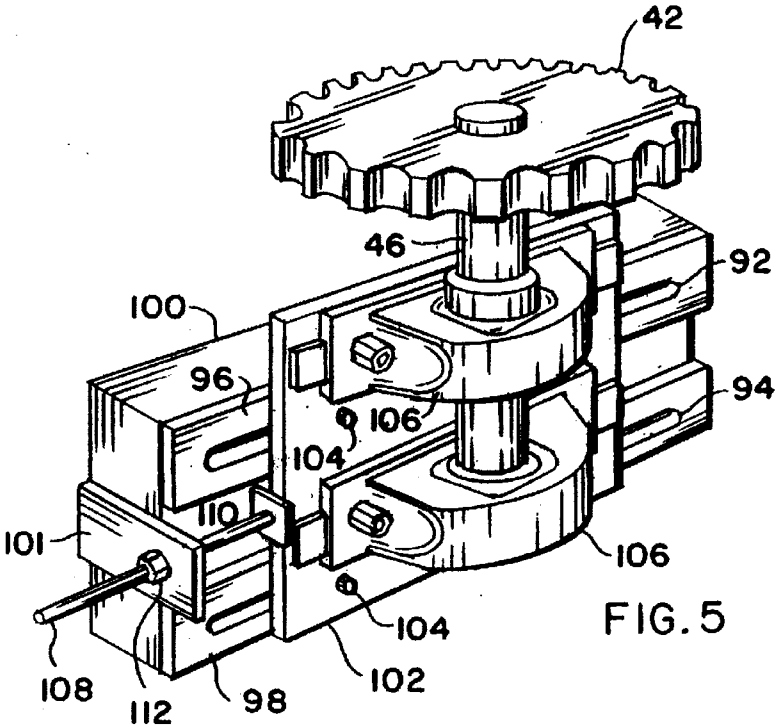
FIG. 5 is an enlarged, fragmentary, perspective view of the takeup sprocket of the retarder.
Figure 4:
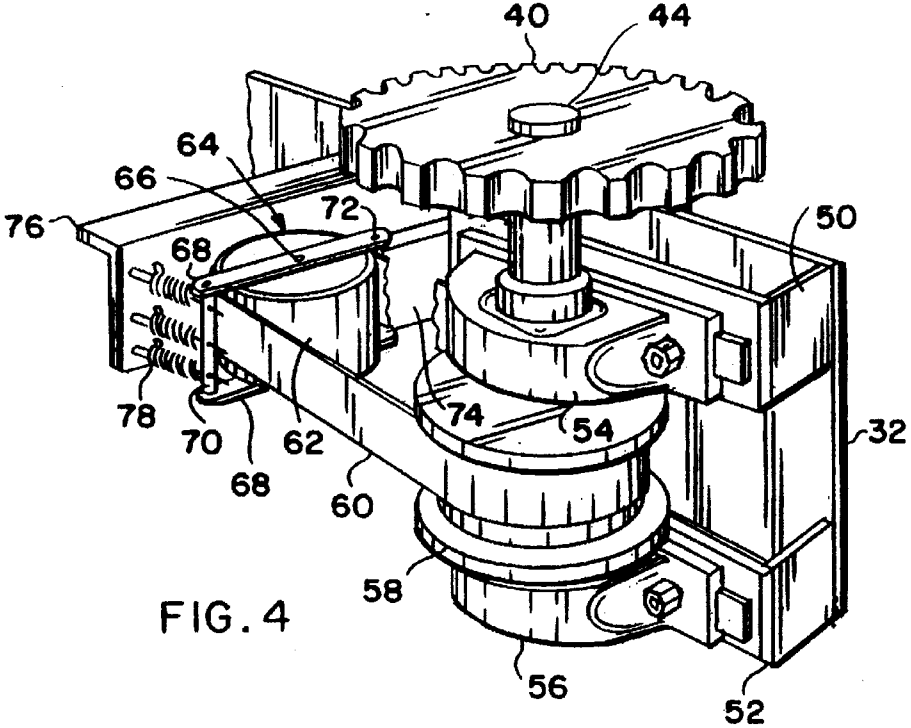
FIG. 4 is an enlarged, fragmentary, perspective view of the drive sprocket of the retarder and the associated centrifugal brake.

The takeup sprocket 42 may be shifted toward and away from the drive sprocket 40 to properly tension the roller chain 38 by movement of the takeup assembly along elongated, longitudinally extending, upper and lower adjustment slots 92 and 94 shown in FIGS. 2 and 5. A pair of elongated, longitudinally extending, upper and lower plates 96 and 98 are mounted on plate 32 at the left end thereof (as viewed in FIGS. 1 and 2) by bracket structure 100, and have the slots 92 and 94 therein respectively. A baseplate 102 is vertically disposed and is flush with plates 96 and 98 and adjustably held thereon by suitable bolt fasteners 104 which extend through slots 92 and 94. Baseplate 102 supports a pair of upper and lower bearing assemblies 106 which mount shaft 46, and hence sprocket 42, for rotation about a vertical axis. An adjustment rod 108 is supported by a bar 101 projecting from structure 100 and has an end plate 110 welded to the left edge of baseplate 102 (as viewed in FIG. 5), and is threaded intermediate its ends so that it is held by a nut 112 that bears against bar 101. This further secures bearings 106 and the associated components on baseplate 102 against movement toward the drive sprocket 40 from the set position.

Figure 7:
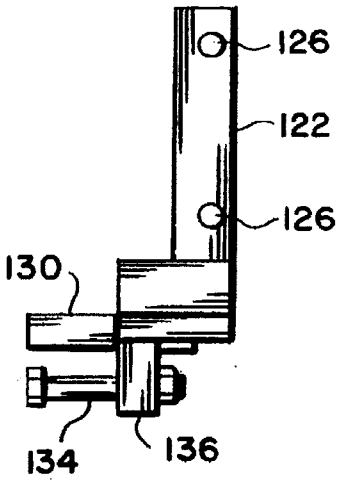
FIG. 7 is an end view of the paddle taken along line 7—7 of FIG. 6, the chain being removed.
Figure 6:
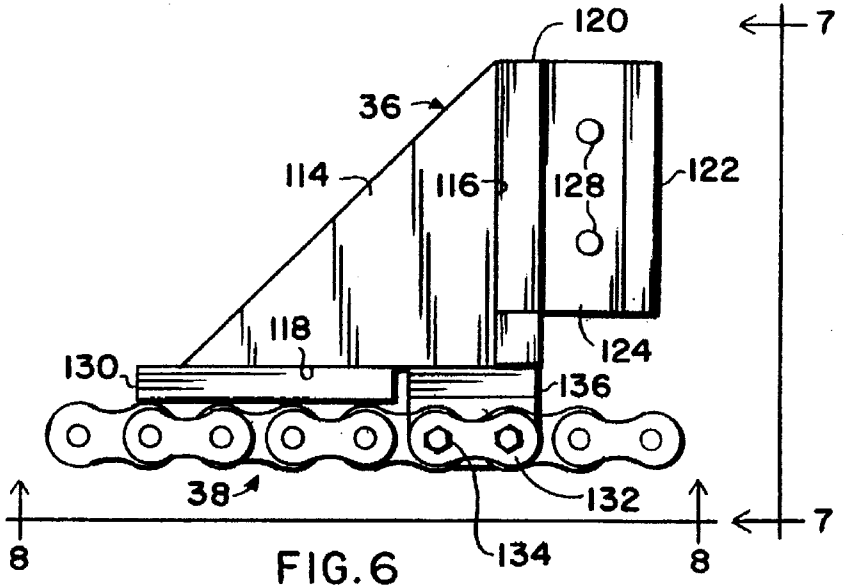
FIG. 6 is an enlarged, plan view of one of the paddles secured to the roller chain.
Figure 8:
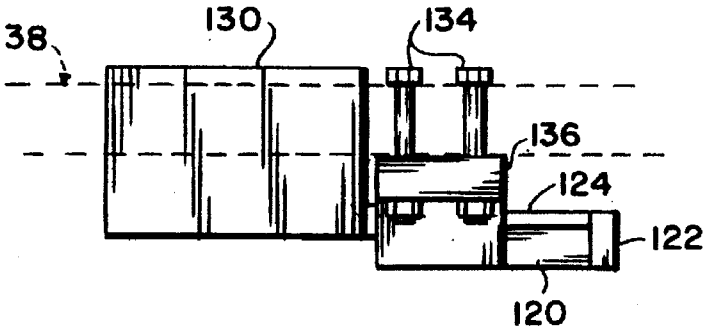
FIG. 8 is a side elevational view of the paddle taken along line 8—8 of FIG. 6, the chain being shown in phantom.

A representative paddle 36 secured to roller chain 38 is shown in detail in FIGS. 6–8. A relatively thin, triangular plate 114 presents essentially a right triangle when viewed in plan (FIG. 6) and is oriented to provide a front edge 116 and an orthogonal side edge 118. A rectangular front piece 120 is welded to plate 114 at edge 116, and is covered in front and on top by wear pads 122 and 124, respectively, which are preferably composed of a plastic material such as a high molecular weight urethane. The front pad 122 is releasably secured to piece 120 by screw fasteners 126, and the top pad 124 is likewise secured by fasteners 128. Accordingly, the wear pads 122 and 124 may be replaced if they become worn.

A back support element 130 in the form of an upwardly projecting, rectangular plate is welded to triangular plate 114 at its side edge 118 and therefore, in stretch 48, extends longitudinally of the track 20 (FIG. 1) in an orthogonal relationship to the main contact surface presented by the vertical face of wear pad 122 (FIG. 7). A comparison of FIGS. 6 and 8 reveals that the outer surface of element 130 bears against several of the links of the roller chain 38 adjacent link 132 to which the paddle 36 is attached. The attachment is accomplished by removing the two pins of link 132 and replacing them with a pair of bolts 134 as shown which extend through the link 132 and through the laterally projecting portion of an angularly shaped lug 136 on plate 114.

Figure 9:
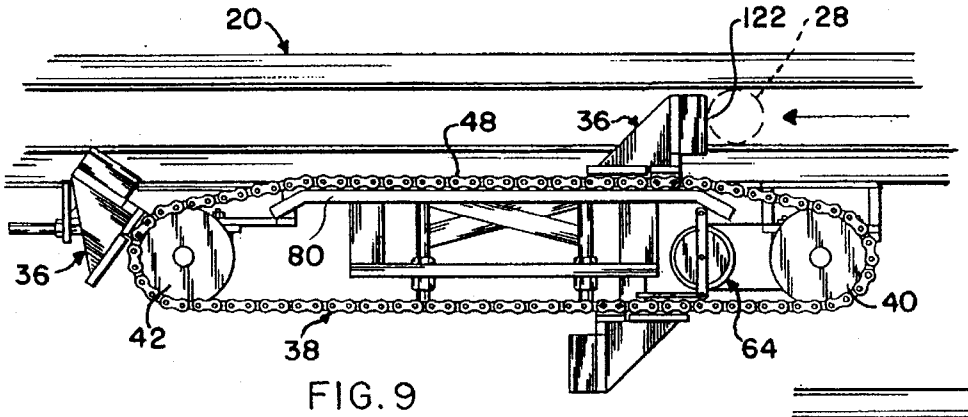
FIGS. 9–11 are simplified, sequential views similar to FIG. 1 illustrating the operation of the apparatus in response to engagement by a conveyor moving in the direction of the arrows.
Figure 10:
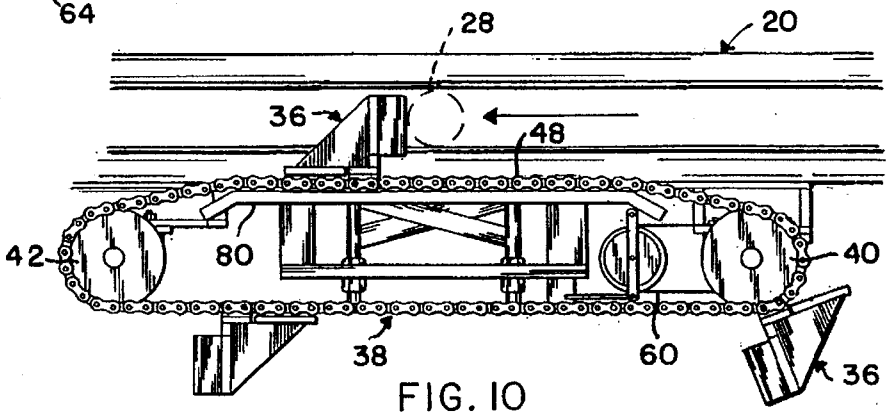
Figure 11:
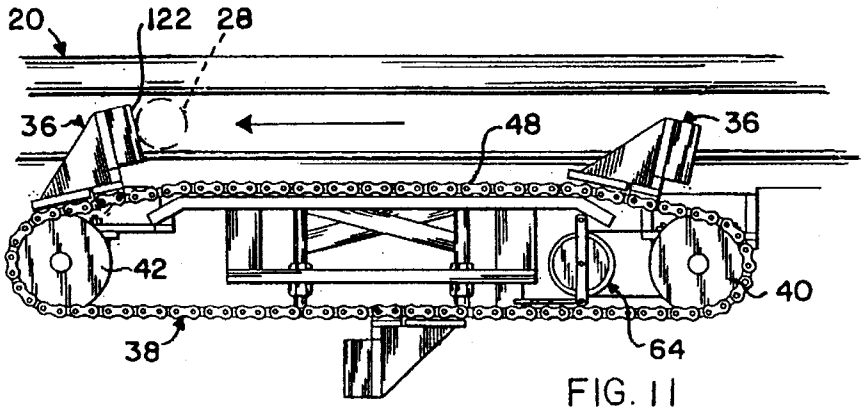

Operation of the retarder apparatus is illustrated in the sequential views of FIGS. 9–11. The spacing of the three paddles 36 assures that one paddle on stretch 48 will at all times be projecting into free track 20 and thus into the path of travel of an oncoming conveyor. This is illustrated in FIG. 9 where the contact surface of wear pad 122, facing opposite to the direction of movement of the conveyor represented by the arrow, is initially engaged by the trolley roller 28. The relationship of the trolley and retarder components is also shown in FIG. 3. Upon impact, the paddle 36 on stretch 48 is pushed in the direction of the arrow as shown in FIG. 10, thereby causing the roller chain 38 to be instantly accelerated to the speed of the conveyor. As long as the conveyor does not exceed a normal speed determined by the torque capacity of the centrifugal brake 64, the paddle 36 is simply pushed as shown in FIGS. 9–11 with no affect upon the speed of the conveyor. It should be noted in FIG. 11 that as soon as the paddle 36 under engagement (adjacent takeup sprocket 42) moves around sprocket 42 and out of the track 20, the next paddle 36 will be inserted into the track.

The same action occurs in the case of a runaway conveyor exceeding the predetermined, normal speed. However, the motion of the chain 38 is transmitted to the centrifugal brake 64 via drive sprocket 40, pulley 58 and drive belt 60. The action of the centrifugal brake limits the speed of movement of the chain 38 and, accordingly, the engaged paddle member 36 holds back the conveyor and causes it to return to the accepted speed.

The desired normal speed may be accurately set by the braking system of the present invention by selection of the centrifugal brake 64 and the diameter of pulley 58. For example, assuming that the maximum speed of a runaway conveyor at entry to the retarder (FIG. 1) is 90 feet per minute (FPM), and that sprocket 40 has a pitch diameter of 1.98 feet, pulley 58 has a diameter of 5.0 inches, and brake drum 62 has a diameter of 4.8 inches, then the speed in RPM of brake drum 62 equals:

$$\frac{90 \times 5.0}{1.98 \times 4.8} = 47.3 \text{ RPM}$$

For a reduction to a normal speed of 50 FPM at exit from the retarder (trolley roller 28 is about to exit in FIG. 11), the required drum speed is:

$$\frac{50 \times 5.0}{1.98 \times 4.8} = 26.3 \text{ RPM}$$

Accordingly, in this example the centrifugal brake 64 provides a speed reduction of 21 RPM at its axis of rotation 66, and is selected to provide the requisite reduction for a conveyor carrying a given load and retarded over the distance from entry to exit. In the embodiment described and illustrated, the trolley roller 28 pushes against the paddle 36 over a distance of 46 inches from entry to exit to retard a conveyor bearing a 2000-pound load. The retarder of the present invention, therefore, may be adapted to a wide range of application requirements by utilizing a centrifugal brake of appropriate capacity and selecting the diameter of pulley 58 to accommodate the speed range of the brake.

It should be appreciated that the action of the chain guide 80 and the support element 130 prevents deflection of the chain 38 at stretch 48 and maintains the contact surface of pad 122 in its operative position shown. Thus, there is no tendency for the engaged paddle 36 to bend back or to be pushed out of the way by the advancing conveyor.

Having thus described the invention, what is claimed as new and desired to be secured by Letters Patent is as follows:

1. In combination with a load-carrying conveyor that runs in a free track, a retarder apparatus for controlling the speed of the conveyor as it moves in a predetermined direction along a path of travel defined by said track, said apparatus comprising:

a pair of spaced, rotatable devices having a flexible, endless, movable component trained therearound, mounting means for supporting said devices and component with a stretch of said component disposed adjacent said path of travel for movement in said direction, a plurality of paddle members secured to said component, extending outwardly therefrom, and sufficiently closely spaced therealong that individual members will be successively positioned on said stretch upon movement of said component, each of said members extending into said path of travel for engagement by said conveyor when positioned on said stretch, and brake means connected with one of said devices for limiting the speed of movement of said component in response to engagement of one of said members by said conveyor, said brake means comprising a centrifugal brake having a preselected capacity, whereby to hold back a runaway conveyor and return it to a normal speed.

2. The combination as claimed in claim 1, wherein said centrifugal brake has an outer drum, and means rotatably coupling said drum with said one device for rotation therewith.

3. The combination as claimed in claim 2, wherein said rotatable coupling means comprises a belt drive.

4. The combination as claimed in claim 1, wherein each of said paddle members presents a contact surface which, when the member is positioned on said stretch, is in said path of travel and has an operative position facing opposite to said predetermined direction.

5. The combination as claimed in claim 1, wherein said apparatus further comprises an elongated guide member along which said stretch is movable, and means mounting said guide member adjacent said track for supporting said stretch against deflection when the paddle member thereon is engaged and pushed by the moving conveyor.

6.The combination as claimed in claim 1, wherein each of said devices includes a sprocket fixed to a shaft and bearing means supporting said shaft, said component comprising a chain on said sprockets, and wherein said mounting means includes means for adjustably positioning the bearing means of one device relative to the other device to tension the chain as required.

7. In combination with a load-carrying conveyor that runs in a free track, a retarder apparatus for controlling the speed of the conveyor as it moves in a predetermined direction along a path of travel defined by said track, said apparatus comprising:

a rotatable device adjacent said path of travel, a movable paddle member extending into said path of travel for engagement by said conveyor and movement in said direction, means connecting said paddle member with said rotatable device for driving the device when the paddle member is engaged and pushed by the conveyor and moved in said direction, and brake means connected with said device for limiting the speed of movement of said paddle member in response to engagement by said conveyor, said brake means comprising a centrifugal brake of preselected capacity having an outer drum, and means rotatably coupling said drum with said device for rotation therewith, whereby to hold back a runaway conveyor and return it to a normal speed.

8. In combination with a load-carrying conveyor that runs in a free track, a retarder apparatus for controlling the speed of the conveyor as it moves in a predetermined direction along a path of travel defined by said track, said apparatus comprising:

a pair of spaced, rotatable devices having a flexible, endless, movable component trained therearound, mounting means for supporting said devices and component with a stretch of said component disposed adjacent said path of travel for movement in said direction, a plurality of paddle members secured to said component, extending outwardly therefrom, and sufficiently closely spaced therealong that individual members will be successively positioned on said stretch upon movement of said component, each of said members extending into said path of travel for engagement by said conveyor when positioned on said stretch, brake means connected with one of said devices for limiting the speed of movement of said component in response to engagement of one of said members by said conveyor, said one device having a rotatable shaft with a pulley thereon, and said brake means comprising a centrifugal brake having an outer drum, and a belt trained around said pulley and said drum, whereby to hold back a runaway conveyor and return it to a normal speed.

9. In combination with a load-carrying conveyor that runs in a free track, a retarder apparatus for controlling the speed of the conveyor as it moves in a predetermined direction along a path of travel defined by said track, said apparatus comprising:

a pair of spaced, rotatable devices having a flexible, endless, movable component trained therearound, mounting means for supporting said devices and component with a stretch of said component disposed adjacent said path of travel for movement in said direction, a plurality of paddle members secured to said component, extending outwardly therefrom, and sufficiently closely spaced therealong that individual members will be successively positioned on said stretch upon movement of said component, each of said members extending into said path of travel for engagement by said conveyor when positioned on said stretch, and including a contact surface having an operative position facing opposite to said predetermined direction, and further including a back support element extending generally orthogonally of said surface and engageable with said component for maintaining said surface in its operative position against force applied upon engagement by said conveyor, and brake means connected with one of said devices for limiting the speed of movement of said component in response to engagement of one of said members by said conveyor, whereby to hold back a runaway conveyor and return it to a normal speed.

* * * * *